US005927660A

United States Patent [19]

McNerney et al.

[11] Patent Number: 5,927,660

[45] Date of Patent: Jul. 27, 1999

[54] PLASTIC BAG HOLDER

[75] Inventors: Jeffrey T. McNerney, Lakewood; Daniel J. Kump, Gates Mills; Joseph P. Kosir, Cleveland, all of Ohio

[73] Assignee: The Unger Company, Cleveland, Ohio

[21] Appl. No.: 08/864,728

[22] Filed: Jun. 9, 1997

[51] Int. Cl.[6] ..... B65D 85/62

[52] U.S. Cl. ..... 248/95; 206/554; 383/9; 383/37; 383/65

[58] Field of Search ..... 248/95, 99, 100, 248/101; 206/554; 383/9, 35, 37, 65; 220/495.03, 495.06, 495.07, 495.1, 495.11

[56] References Cited

U.S. PATENT DOCUMENTS

| | | | |
|---|---|---|---|
| D. 332,404 | 1/1993 | Monighetti et al. . | |
| D. 372,826 | 8/1996 | Hecker . | |
| 3,754,771 | 8/1973 | Shagoury . | |
| 4,358,083 | 11/1982 | Haubrich . | |
| 4,940,201 | 7/1990 | Kurth . | |
| 5,100,000 | 3/1992 | Huseman | 206/554 |
| 5,419,437 | 5/1995 | Huseman | 206/554 |
| 5,513,823 | 5/1996 | Bresnahan . | |
| 5,524,762 | 6/1996 | Shafran et al. | 248/95 X |
| 5,575,393 | 11/1996 | Gebhardt . | |
| 5,577,615 | 11/1996 | Wile et al. . | |

*Primary Examiner*—Ramon O. Ramirez
*Assistant Examiner*—Long Dinh Phan
*Attorney, Agent, or Firm*—Fay, Sharpe, Beall, Fagan, Minnich & McKee

[57] ABSTRACT

A bag holding system includes a stand, such as a header A-frame stand, or a beltboard. The stand includes a slot for receiving a tab defined on a bag assembly adapter. The bag assembly adapter also includes at least one first connector member for connecting with a second connector member defined on a bag assembly such as a saddle pack. The saddle pack is formed from a number of stacked polymeric sheets each including a first bag, a second bag, and a center strip portion having a first edge connected to the first bag and a second edge connected to the second bag. The second connector member includes an aperture extending through the center strip portions. The at least one first connector member of the bag assembly adapter may include a leg portion having a nub projecting through the aperture of the bag assembly so as to secure the bag assembly to the bag assembly adapter.

32 Claims, 13 Drawing Sheets

24
44
41a
42
40
44
40
41b
50
52
38
52
48
52
50
46
52
48
10
20
22
14
22
20
15
16
70
62
65
66
64
65
12a
12b
12c
12d
18
60

PLASTIC BAG HOLDER

BACKGROUND OF THE INVENTION

The present invention relates to object holders. It finds particular application in conjunction with a holder for supporting a plurality of plastic bags and will be described with particular reference thereto. However, it should be appreciated that the present invention may also find application in conjunction with other types of holding devices or systems for supporting objects.

Deli pouches, as they are commonly referred to in the plastic bag industry, are plastic bags used for holding and storing cold cuts, cheeses, and the like, which are purchased from deli or meat/cheese counters often found in grocery stores. Deli pouches are typically formed from a natural (i.e., translucent) high-density polyethylene (HDPE) material. Such pouches are manufactured and sold to grocery stores in two basic configurations, namely, a saddle pack and a header or staple pack.

A saddle pack is formed by securing a number of layers of deli pouches together in a stacked arrangement. Each layer of deli pouches consists of a central strip of plastic film connecting the top or open ends of two mutually opposing deli pouches together. A score line or perforation permits each deli pouch to be easily separated from the central strip of plastic film. The stacked layers of deli pouches are typically secured together by heat sealing the central strips of plastic film at one or more locations. Saddle packs generally contain 200 deli pouches with 100 deli pouches stacked on each side of the central strips of plastic film.

A header pack is formed by securing a number of stacked deli pouches to a header card, which is typically formed from cardboard, or the like. In particular, a top or open end of each deli pouch is secured to a strip of plastic film. A score line or perforation permits each deli pouch to be easily separated from the respective strip of plastic film. The deli pouches and strips of plastic film are registered together, and the strips of plastic film are then stapled or otherwise secured to the header card. Header packs generally contain 100 deli pouches secured to a header card.

The saddle packs and header packs are typically dispensed from a stand which supports a saddle or header pack. There are two types of stands commonly used throughout the grocery industry for supporting deli packs, an A-frame stand and a beltboard. An A-frame stand is tent-shaped and is typically formed from plastic, covered wire, or stainless steel. The A-frame stand is generally placed on top of a deli counter or on a shelf behind the deli counter. In contrast, a beltboard is generally affixed to a vertical surface such as a wall with double-backed tape, screws, or the like.

A saddle A-frame stand supports saddle packs, and a header A-frame stand supports header packs. A saddle A-frame stand includes two spaced-apart posts extending upward from a top edge portion of the saddle A-frame stand. Saddle packs include mutually conforming apertures through the central strips of plastic material which permit the posts to extend therethrough. Thus, a saddle pack is positioned over a saddle A-frame stand such that each side of the saddle pack (i.e., 100 deli pouches) rests upon a respective angled side surface of a saddle A-frame.

A header A-frame stand includes an elongate slot extending substantially along the top edge portion of the stand. A lower end portion of a header card is inserted into the slot so that the deli pouches rest upon an inclined surface of the header A-frame stand. Two opposed header cards may be inserted into the elongate slot such that a header pack (i.e., 100 deli bags) rests upon each angled side surface of a header A-frame stand.

A beltboard is a smaller dispenser which is generally used with header packs. A beltboard includes a base surface with a metal band or belt secured thereto. A portion of the band is spaced from the base surface thereby defining an aperture or slot for receiving a lower end portion of a header card therein.

Reclosable, zippered, deli pouches are finding wide acceptance from consumers. Thus, there is great demand to manufacture and supply zippered deli bags to stores throughout the grocery industry. Zippered deli pouches are generally manufactured and sold in saddle pack configurations only. One reason is that zippered deli pouches can not be reliably stacked, registered, and stapled to a header card in a header pack configuration. In particular, the thickness of a single zippered deli pouch s substantially greater at the zippered open end portion as compared to the remainder of the deli pouch. The cumulative thickness of a number of stacked deli pouches (i.e., 100) at the zippered open end portions prevents the deli pouches from maintaining registry and from being reliably stapled to a header card.

Heretofore, grocery chains which have previously utilized header A-frame stands and beltboards for dispensing header packs of deli pouches, have had to incur additional expenses to switch to dispensing saddle packs of reclosable, zippered deli pouches. That is, header A-frame stands and beltboards are not designed to support saddle packs. Thus, grocery chains which have previously utilized header A-frame stands and beltboards must disadvantageously purchase new dispensing stands which support saddle packs of reclosable, zippered deli pouches (e.g., saddle A-frame stands). In addition, the grocery chains must disadvantageously dispose of all of their now unusable header A-frame stands and beltboards.

Accordingly, it has been considered desirable to develop a new and improved saddle pack adapter which meets the above-stated needs and overcomes the foregoing difficulties and others while providing better and more advantageous results.

SUMMARY OF THE INVENTION

In accordance with one aspect of the present invention, a bag holding system is disclosed. The bag holding system includes a support member having a slot, a bag assembly having a first connector member, and an adapter having a second connector member connected to said first connector member and having a tab inserted into said slot to support said bag assembly on said support member.

In accordance with another aspect of the present invention, a bag assembly adapter is disclosed. The bag assembly adapter includes a planar member, a first connector member forming a first portion of said planar member for engaging a second connector member associated with a bag assembly, and a tab member forming a second portion of said planar member for engaging with a support member to support said bag assembly on said support member.

In accordance with yet another aspect of the present invention, a method of securing a bag assembly to a support member is disclosed. The bag assembly includes a number of stacked polymeric sheets each including a bag portion connected to a center strip portion by one of a score line or a perforation. The center strip portions are joined together and have a connector member associated therewith. The method includes securing a first portion of an adapter member to the connector member, and securing a second portion of the adapter member to the support member.

One advantage of the present invention is the provision of a saddle pack adapter which permits saddle packs of deli pouches to be used in conjunction with header A-frame stands and beltboards.

Another advantage of the present invention is the provision of a saddle pack adapter which permits two saddle packs of different size deli pouches to be supported on an A-frame stand.

Still further advantages of the present invention will become apparent to those of ordinary skill in the art upon reading and understanding the following detailed description of the preferred embodiments.

BRIEF DESCRIPTION OF THE DRAWINGS

The invention may take physical form in certain components and arrangements of same, several preferred embodiments of which will be described in detail in this specification and illustrated in the accompanying drawings which form a part hereof and wherein.

DETAILED DESCRIPTION OF THE PREFERRED EMBODIMENTS

Figure 1:
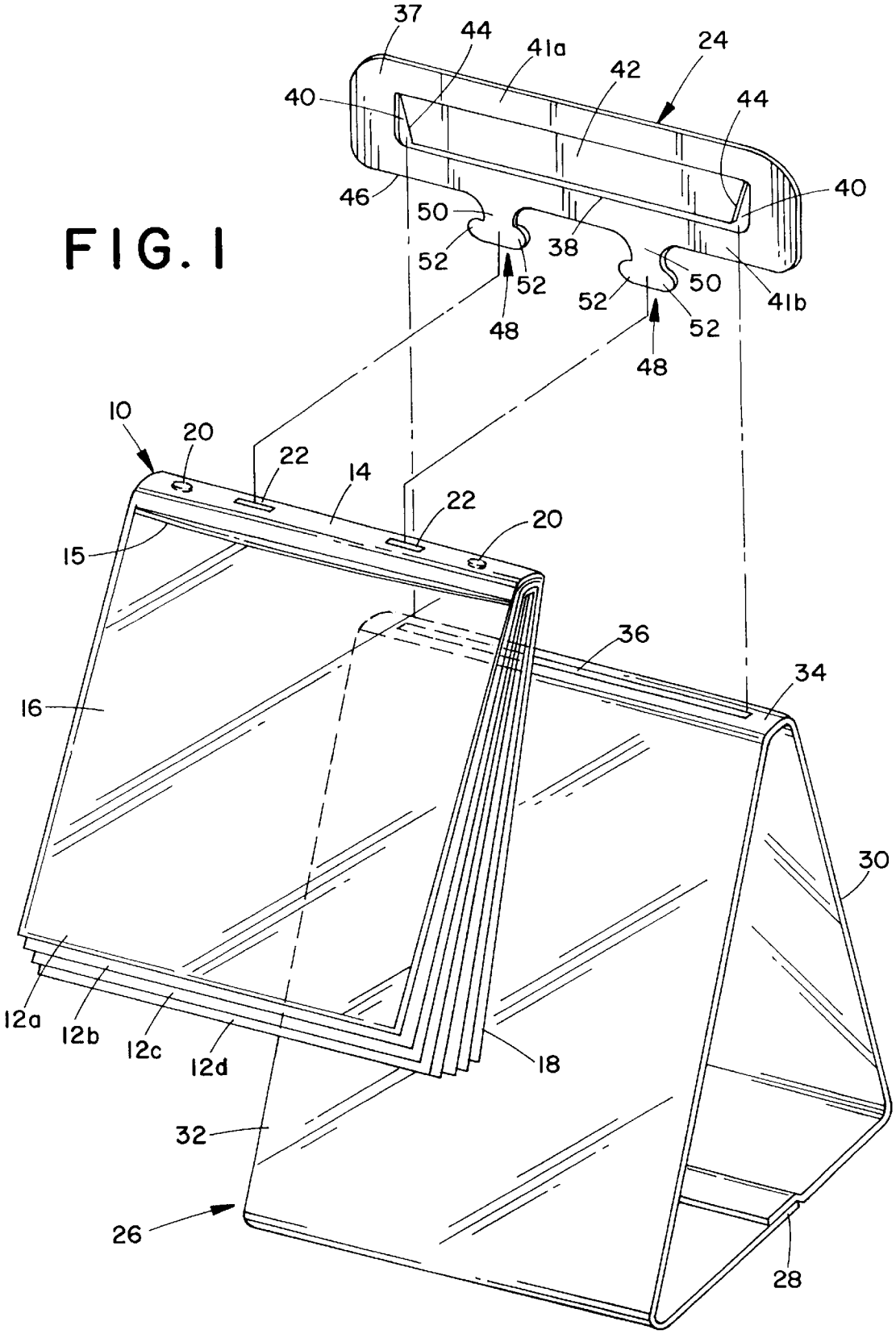
FIG. 1 is an exploded perspective view of a saddle pack of deli pouches, a header A-frame stand, and a saddle pack adapter for hanging the saddle pack on the A-frame stand.

With reference to FIG. 1, a saddle pack 10 includes a number of layers of plastic material 12*a*–12*d*. Each layer of plastic material 12*a*–12*d* consists of a central strip of plastic film 14 connecting the top or open zippered ends 15 of two mutually opposing deli pouches 16, 18 together. A score line or perforation (not visible) proximate the zippered portion 15 permits each deli pouch 16, 18 to be easily separated from the central strip of plastic film 14. The stacked layers of deli pouches are typically secured together by one or more heat seals 20 extending through the central strips of plastic film 14.

The saddle pack 10 also includes one or more connector members, such as apertures 22, for engaging with a securing means on an associated stand. In the present invention, the apertures 22 are engaged by a saddle pack adapter 24. The apertures 22 extend through the central strips of plastic film 14. The apertures 22 are shown as slots. However, it should be appreciated that the apertures 22 may have any desired shape such as circular, triangular, square, etc.

A header A-frame stand 26 takes the form of a triangle in cross section and includes a base portion 28 and two angled side walls 30, 32 extending upward from opposing ends of the base portion 28. The side walls 30, 32 converge at an upper edge 34. An elongate slot 36 extends substantially along the upper edge 34. The header A-frame stand may be formed from plastic, covered wire, or stainless steel.

The saddle pack adapter 24 is preferably formed from a sheet of material 37. The saddle pack adapter 24 includes an elongate slit 38 and two contoured apertures 40 communicating with and extending transversely from opposing ends of the elongate slit 38. The slit 38 divides the adapter 37 into an upper transverse rung 41*a* and a lower transverse rung 41*b* whereby the adapter forms a closed loop. The slit 38 and apertures 40 cooperate to define a resilient cantilevered tab 42 that is formed integral with the upper rung 41*a*. The tab 42 includes tapered side walls 44 which are convergent in a direction toward a free end edge of the tab 42.

A lower end edge 46 of the transversed rung 41*b* includes one or more connector members 48 which cooperate with the connector members 22 of the saddle pack 10 to join the saddle pack adapter 24 to the saddle pack. In the embodiment being described, two spaced connector members 48 extend from the lower end edge 46. The two connector members 48 each include a leg 50 and, extending from a distal end thereof, two nubs 52 projecting from opposing sides of the leg.

The saddle pack adapter 24 may be formed by molding, die cutting, stamping, etc., a polymeric material such natural HDPE. In the embodiment being described, the saddle pack adapter 24 can be die cut from approximately 0.050 thick HDPE material.

Figure 5A:
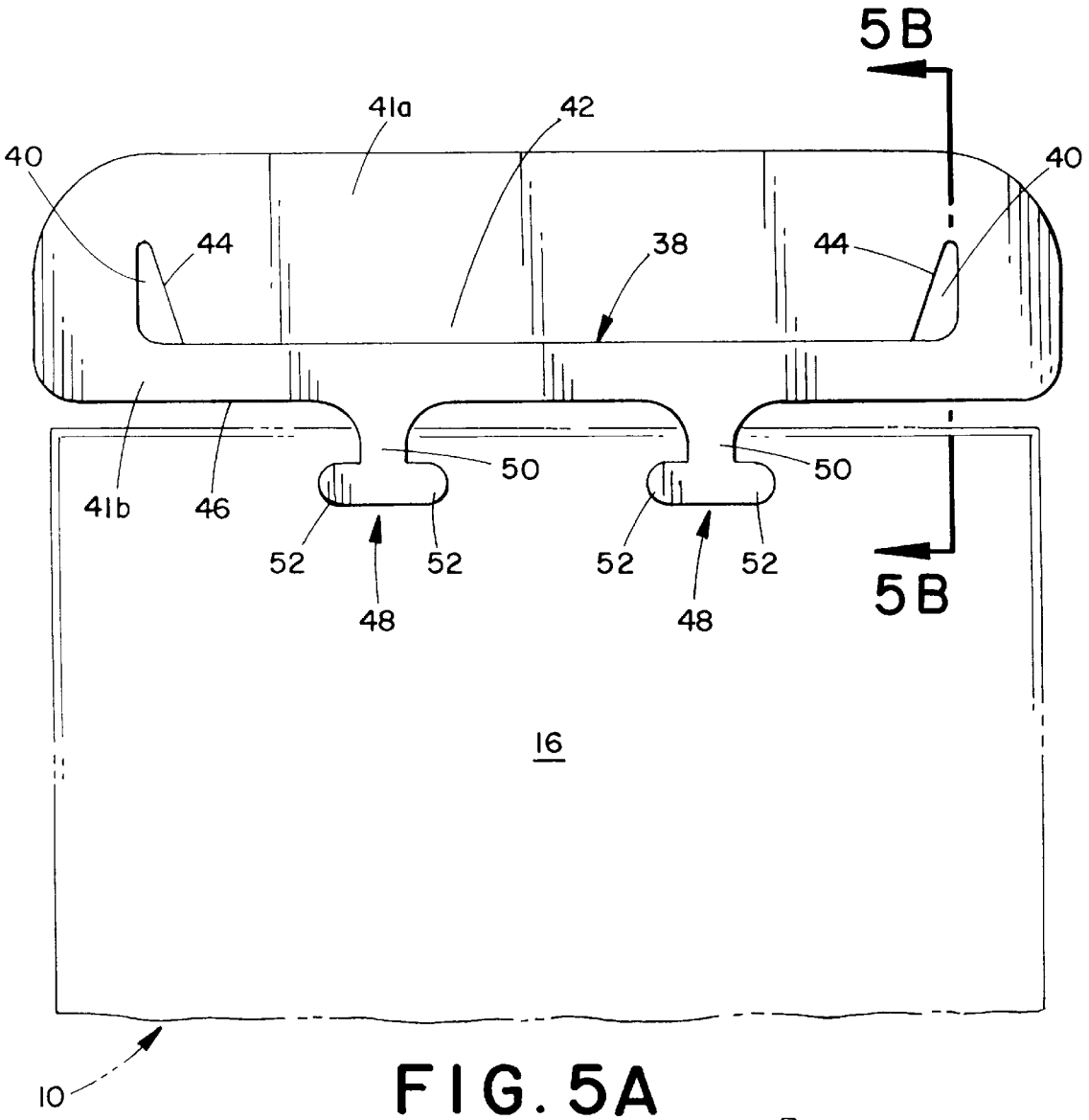
FIG. 5A is a front elevational view of the saddle pack adapter of FIG. 1 secured to a saddle pack, shown in phantom.
Figure 5B:
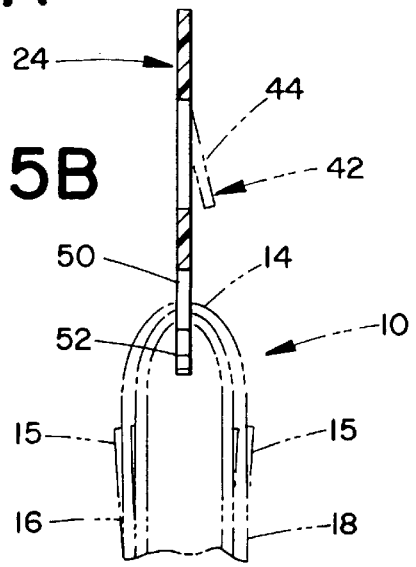
FIG. 5B is a section view taken along the line 5B—5B of FIG. 5A.

The saddle pack adapter 24 is secured to the saddle pack 10 by joining connector members 22 with connector members 48. In the embodiment being described, the legs 50 are pushed into the slots 22. It should be appreciated that the width/diameter of the slots 22 is approximately equal to the width of the legs 50. The nubs 52 can be urged through the slots 22 because one or both connector members 22 and 48 are formed from resilient, bendable, or otherwise deformable material. Once the nubs 52 have passed through the slots 22, the nubs extend so as to prevent the saddle pack from separating from the saddle pack adapter, as shown in FIGS. 5A and 5B.

Figure 2:
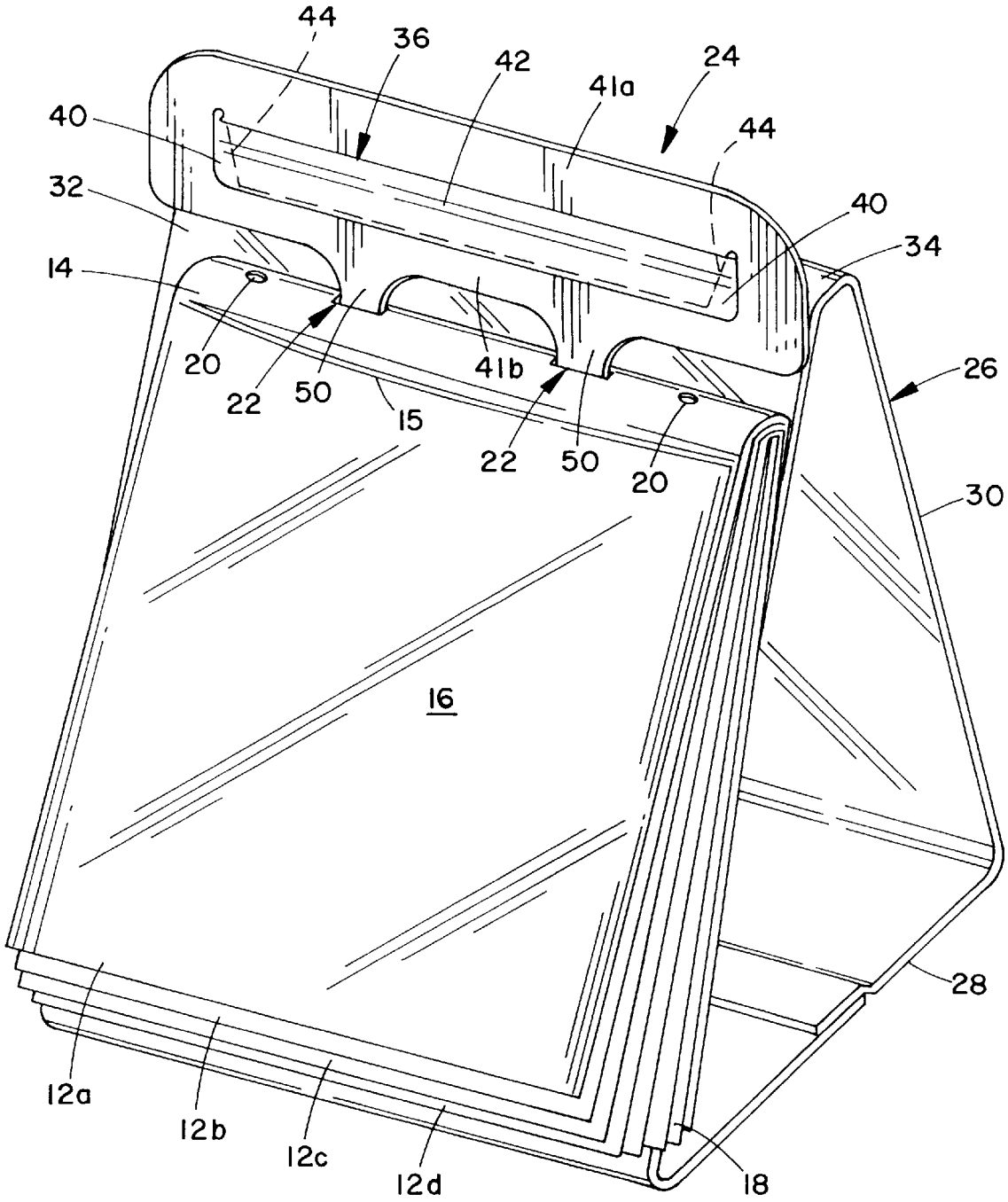
FIG. 2 is a perspective view of a saddle pack secured to a header A-frame stand by the saddle pack adapter of FIG. 1.

Referring now to FIG. 2, with the saddle pack adapter 24 secured to the saddle pack 10, the adapter 24 is mounted on the A-frame stand 26. In particular, the tab 42 is pivoted out of the plane of the saddle pack adapter 24 and then inserted into the slot 36 associated with upper edge 34. The tapered side walls 44 facilitate inserting the tab 42 completely into the slot 36. The closed end portion of the tab 42 is positioned proximate the upper edge 34 when the tab 42 is seated in the slot 36.

When the saddle pack adapter 24 is inserted in the slot 36, the deli pouches 16 extend outwardly from the A-frame stand and are available for receiving cold cuts, cheese, etc. The deli pouches 18 rest inwardly against one of the side surfaces 30, 32 of the A-frame stand 26 when the deli pouches 16 extend outwardly from the A-frame stand 26. When the deli pouches 16 are expended (i.e., separated from the respective strips 14), the saddle pack adapter 24 may then be removed, rotated 180°, and reinserted into the slot 36 so that the deli pouches 18 extend outwardly from the A-frame stand 26. Alternatively, the saddle pack adapter 24 may be repositioned so that the saddle pack 10 rests against the other angled side surface 30, 32 of the A-frame stand 26.

The width of the slot 36 associated with the A-frame stand 26 is sufficiently large to receive two saddle pack adapters 24, or more particularly tabs 42, at the same time. That is, a first saddle pack may rest against angled side surface 30 at the same time that a second saddle pack rests against angled side surface 32. If desired, the first saddle pack may include deli pouches 16, 18 having one or more first characteristics (e.g., size, quantity, thickness, etc.) while the second saddle pack includes deli pouches 16, 18 with one or more different characteristics. Thus, the saddle pack adapter 24 permits one or more saddle packs 10 to hang from a header A-frame stand 26, which stand 26 is normally used only in conjunction with header packs.

Figure 3:
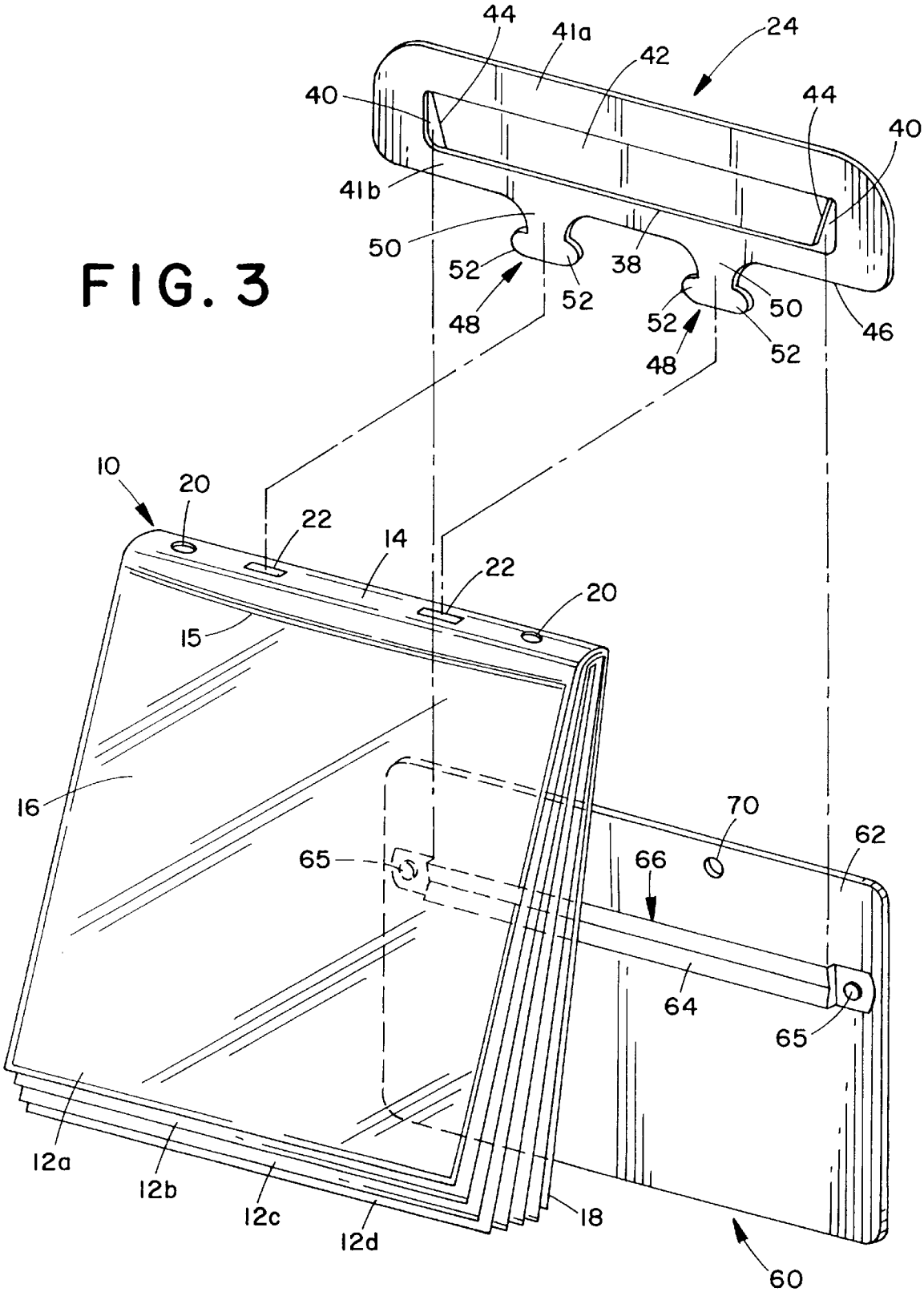
FIG. 3 is an exploded perspective view of a saddle pack of deli pouches, a beltboard, and the saddle pack adapter of FIG. 1 for hanging the saddle pack on the beltboard.
Figure 4:
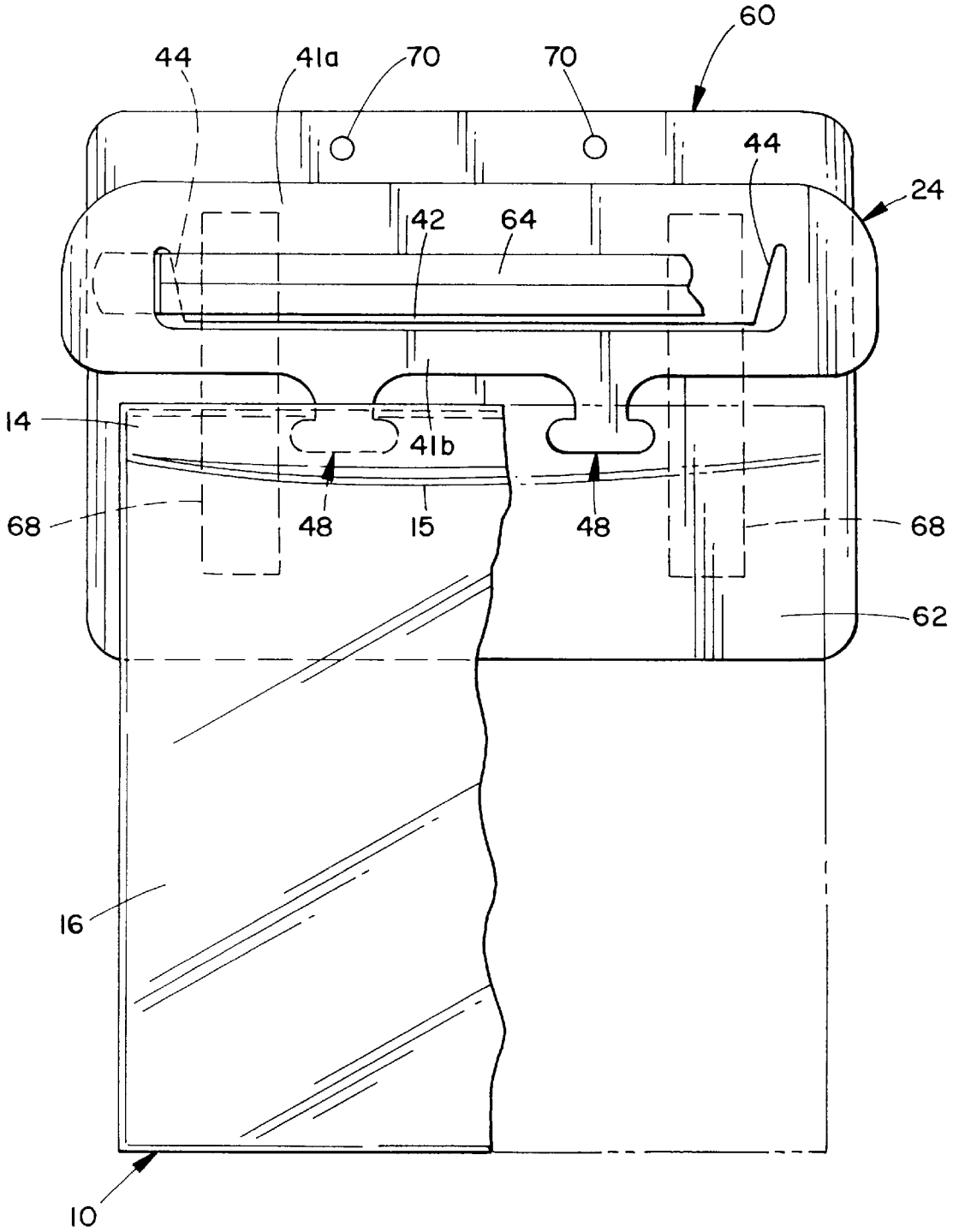
FIG. 4 is a front elevational view, partially broken away, of a saddle pack secured to a beltboard by the saddle pack adapter of FIG. 1.

Referring now to FIGS. 3 and 4, the saddle pack 10 and the saddle pack adapter 24 may also be secured to a beltboard 60. The beltboard 60 includes a base surface 62 and a band or belt 64 secured to the base surface 62 with securing means such as bolts, screws, rivets, etc. 65. A portion of the band 64 is spaced from the base surface 62 so as to define an aperture or slot 66. The beltboard 60 may be affixed to a vertical surface such as a wall with double-backed tape 68 (FIG. 4), or with bolts, screws, rivets, or the like. In addition, the beltboard 60 may be hung on a vertical surface by passing one or more hooks (not shown) through aperture(s) 70 formed in the beltboard 60.

When the saddle pack adapter 24 is secured to the saddle pack 10 as described above, the adapter 24 is then mounted on the beltboard 60. In particular, the tab 42 is pivoted out of the plane of the saddle pack adapter 24 and then inserted into the slot 66 associated with band 64. The tapered side walls 44 of the tab 42 facilitate inserting the tab 42 completely into the slot 66. The closed end portion of the tab 42 is positioned proximate the top edge of the band 64 when the tab 42 is seated in the slot 66.

With the saddle pack adapter 24 inserted in the slot 66, the deli pouches 16 extend outwardly from the beltboard 60 and are available for receiving cold cuts, cheese, etc. The deli pouches 18 rest inwardly against the base surface 62 of the beltboard 60 when the deli pouches 16 extend outwardly from the beltboard. When the deli pouches 16 are expended (i.e., separated from the respective strips 14), the saddle pack adapter 24 may then be removed, rotated 180°, and then reinserted into the slot 66 so that the deli pouches 18 extend outwardly from the beltboard. Thus, the saddle pack adapter 24 permits a saddle pack 10 to hang from a beltboard 60, which beltboard is normally used only in conjunction with header packs.

Figure 10:
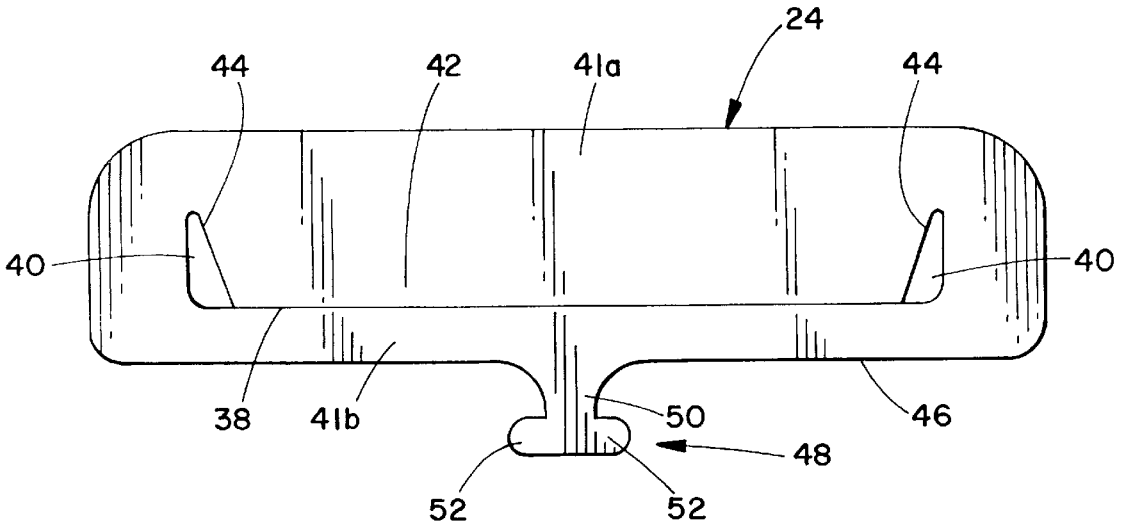
FIG. 10 is a front elevational view of a sixth embodiment of a saddle pack adapter in accordance with the present invention.
Figure 11:
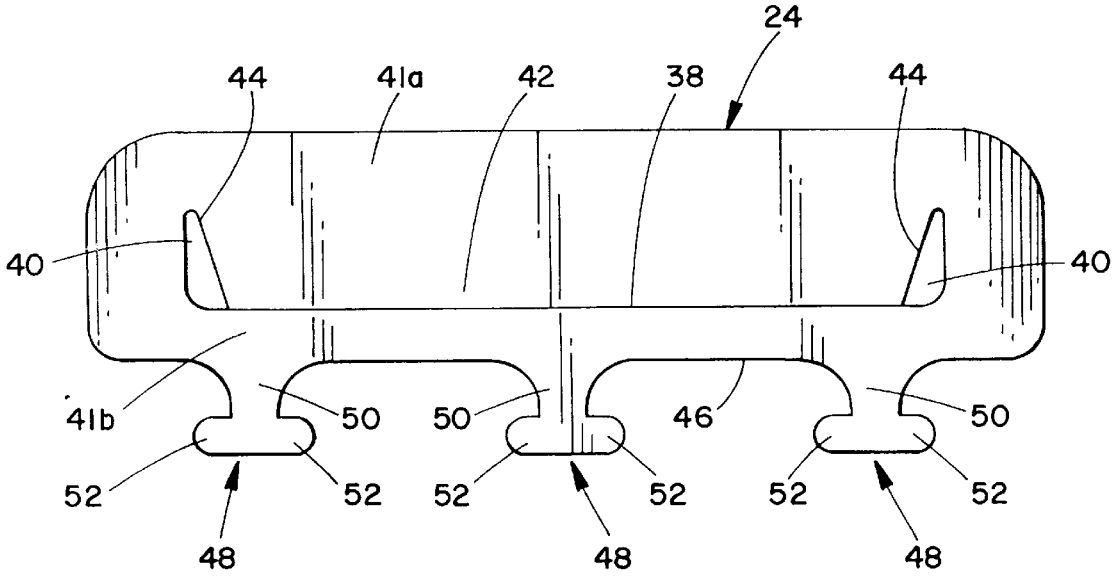
FIG. 11 is a front elevational view of a seventh embodiment of a saddle pack adapter in accordance with the present invention.

It should be appreciated that the saddle pack adapter 24 may be secured to a saddle pack 10 having any number of connector members 22. For instance, as shown in FIG. 10, the saddle pack adapter 24 may include only one connector member 48 for joining with a connector member 22 associated with a saddle pack 10. Likewise, as shown in FIG. 11, the saddle pack adapter 24 may include three connector members 48 for joining with three connector members 22 associated with a saddle pack 10.

Figure 6A:
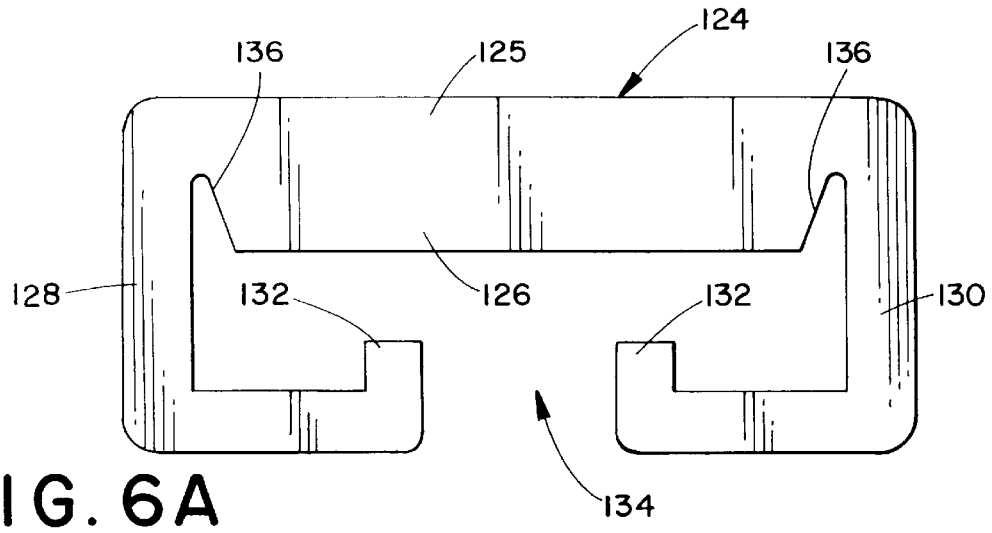
FIG. 6A is a front elevational view of a second embodiment of a saddle pack adapter in accordance with the present invention.
Figure 6B:
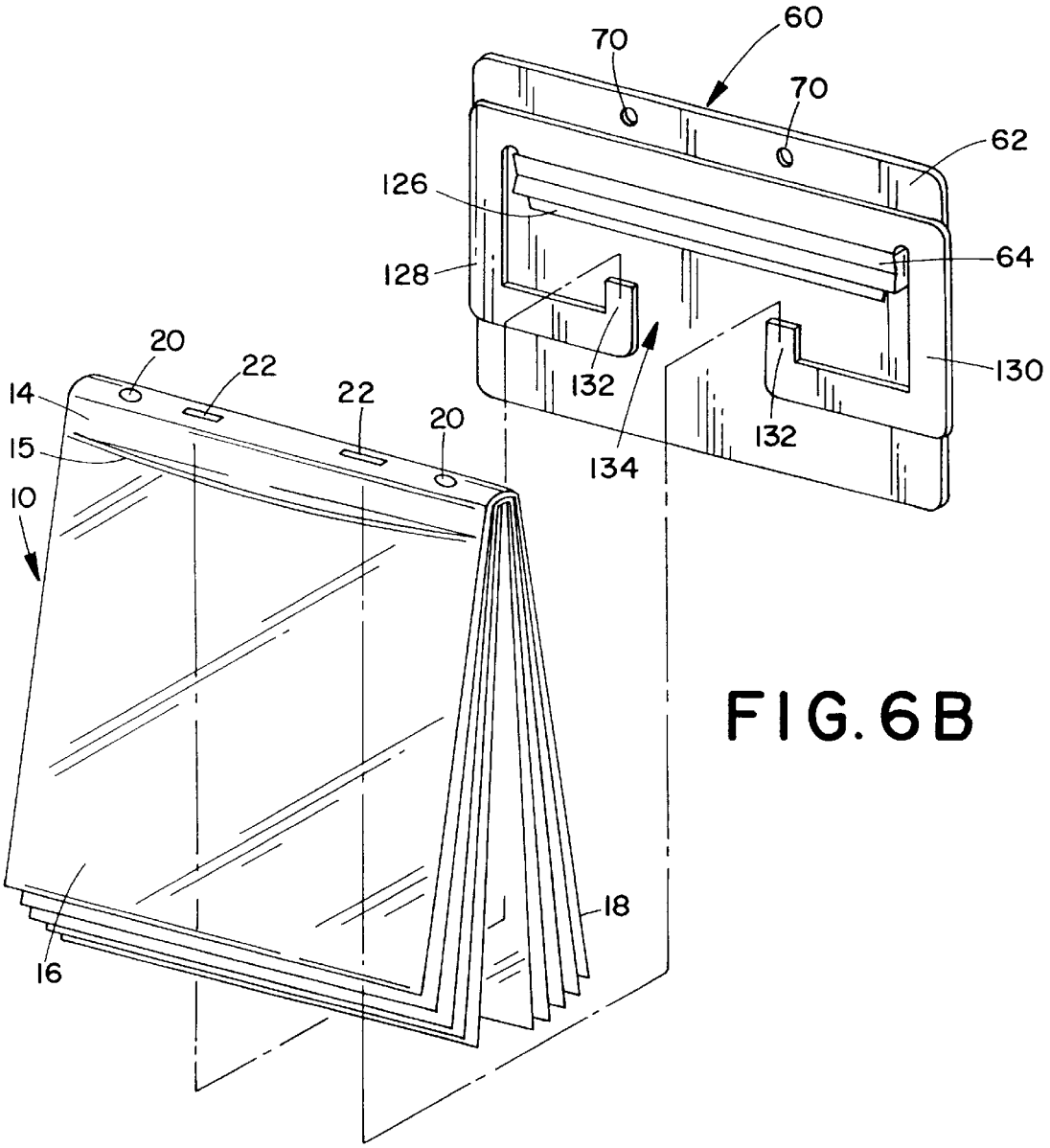
FIG. 6B is an exploded perspective view of a saddle pack of deli pouches, a beltboard, and the saddle pack adapter of FIG. 6A secured to the beltboard for hanging the saddle pack on the beltboard.
Figure 6C:
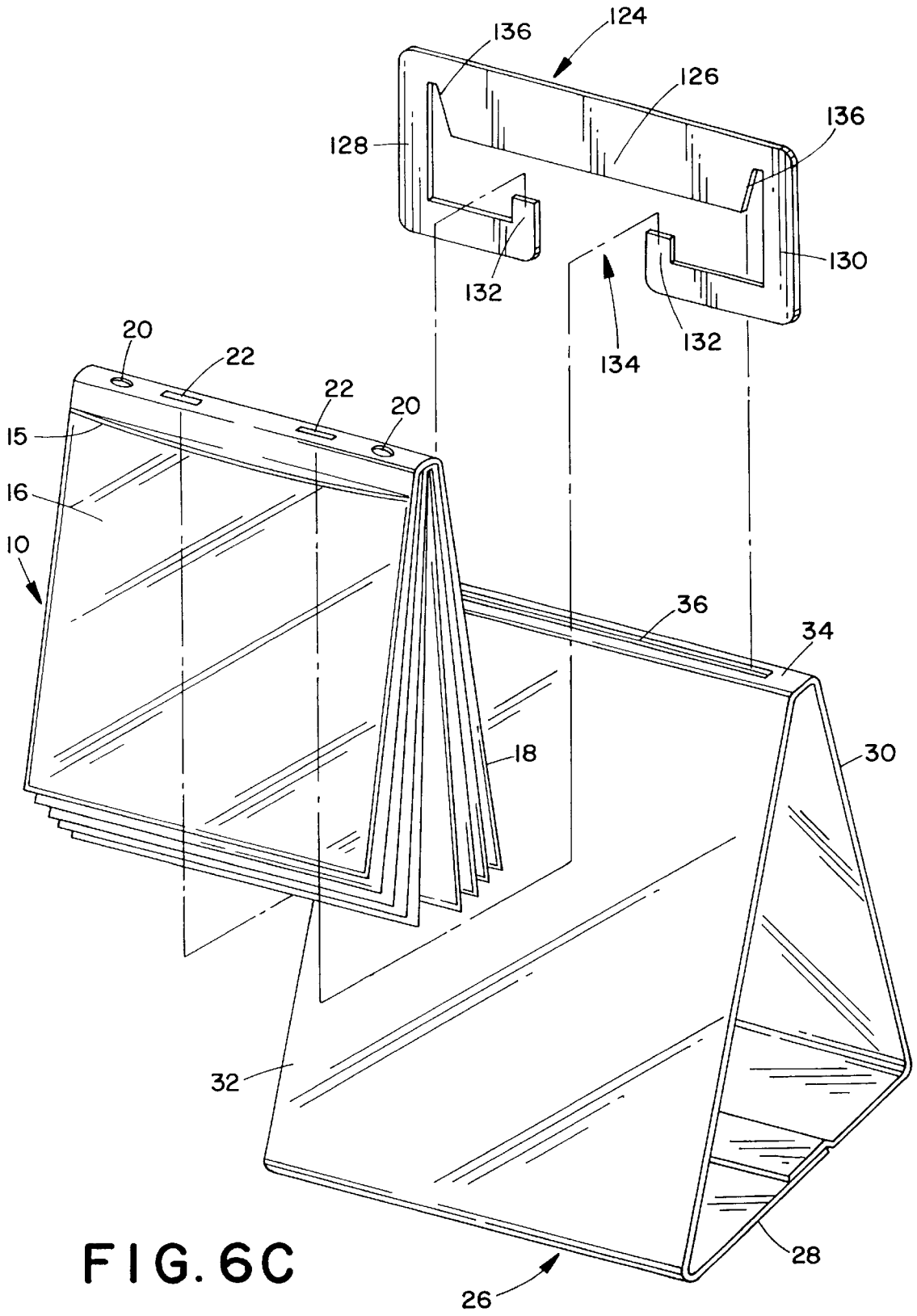
FIG. 6C is an exploded perspective view of a saddle pack of deli pouches, a header A-frame stand, and the saddle pack adapter of FIG. 6A for hanging the saddle pack on the A-frame stand.

Referring now to FIGS. 6A, 6B, and 6C, a saddle pack adapter 124 according to a second embodiment of the present invention is there shown. The saddle pack adapter 124 is formed from a planar material 125 and is adapted for securing a saddle pack 10 to a header A-frame stand 26 (FIG. 6C) or a beltboard 60 (FIG. 6B). The saddle pack adapter 124 includes a cantilevered tab portion 126 and two mutually opposing L-shaped connector or leg members 128, 130 extending from opposite ends of the tab 126.

A free end of each L-shaped connector member 128, 130 includes a nub 132 extending toward the tab portion 126. The tab portion 126 and connector members 128, 130 cooperate to define an open recess 134. The tab portion 124 includes tapered side walls 136 which are convergent within the recess 134 in a direction toward the nubs 132. The saddle pack adapter 124 may be formed by molding, die cutting, stamping, etc., a polymeric material such natural HDPE.

The L-shaped connector members 128, 130 cooperate with the connector members 22 of the saddle pack 10 to join the saddle pack adapter 124 to the saddle pack. In the embodiment being described, the central strips of plastic material 14 are positioned within the recess 134 whereby the L-shaped connector members 128, 130 are interposed between the deli bags 16 and deli bags 18. The slots 22 associated with the saddle pack 10 are then urged over the nubs 132 associated with the L-shaped connector members 128, 130. It should be appreciated that the width/diameter of the slots 22 are approximately equal to the width of the nubs 132. Once the nubs 132 have passed through the slots 22, the nubs 132 prevent the saddle pack from separating from the saddle pack adapter 124.

With the saddle pack adapter 124 secured to the saddle pack 10, the adapter 124 may then be mounted on an A-frame stand 26 as shown in FIG. 6C. In particular, the tab portion 126 is pivoted out of the plane of the saddle pack adapter 124 and a free end edge of the tab portion 126 is inserted into the slot 36 associated with top edge portion 34. The tapered side walls 136 facilitate inserting the tab 126 completely into the slot 36. The closed end portion of the tab 126 is positioned proximate the top edge portion 34 when the tab 126 is seated in the slot 36.

When the saddle pack adapter 124 is inserted in the slot 36, the deli pouches 16 extend outwardly from the A-frame stand and are available for receiving cold cuts, cheese, etc. The deli pouches 18 rest inwardly against one of the side surfaces 30, 32 of the A-frame stand 26 when the deli pouches 16 extend outwardly from the A-frame stand 26. Once the deli pouches 16 have all been used, the saddle pack adapter 124 may then be removed, rotated 180°, and then reinserted into the slot 36 to make the deli pouches 18 available for use.

The saddle pack 10 and the saddle pack adapter 124 may also be secured to a beltboard 60, as shown in FIG. 6B. When the saddle pack adapter 124 secured to the saddle pack 10 as described above, the adapter 124 is then mounted on the beltboard 60. In particular, the tab portion 126 is pivoted out of the plane of the saddle pack adapter 124 and a free end edge thereof is inserted into the slot 66 associated with band 64. The tapered side walls 136 of the tab 126 facilitate inserting the tab 126 completely into the slot 66. The closed end portion of the tab 126 is positioned proximate the top edge of the band 64 when the tab 126 is seated in the slot 66.

With the saddle pack adapter 124 inserted in the slot 66, the deli pouches 16 extend outwardly from the beltboard 60 and are available for receiving cold cuts, cheese, etc. At this time, the deli pouches 18 rest inwardly against the base surface 62 of the beltboard 60. Once the deli pouches 16 are all used, the saddle pack adapter 124 may then be removed, rotated 180°, and then reinserted into the slot 66 in order to allow the deli pouches 18 to extend outwardly from the beltboard.

Figure 7A:
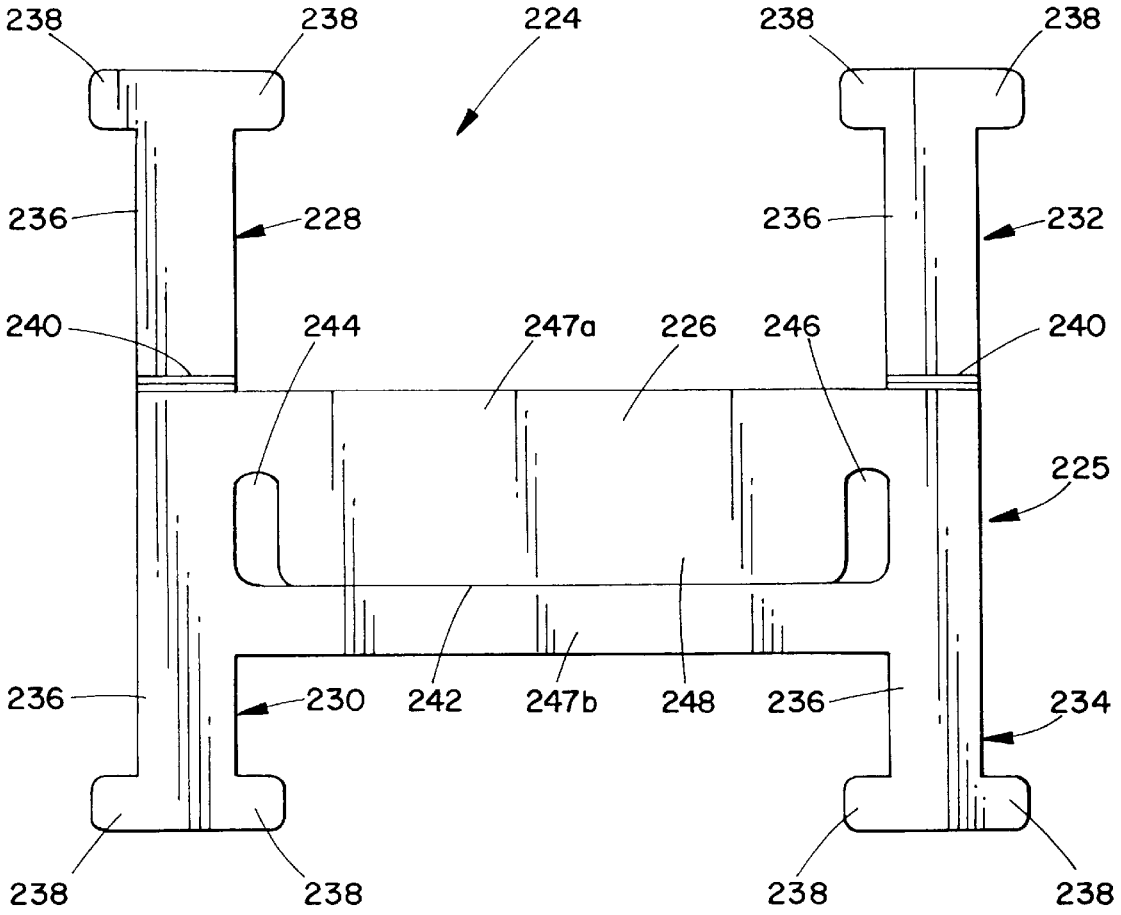
FIG. 7A is a top plan view of a third embodiment of a saddle pack adapter in accordance with the present invention.

Referring now to FIG. 7A, a saddle pack adapter 224 according to a third embodiment of the present invention is there shown. The saddle pack adapter 224 is formed from a substantially H-shaped planar member 225 and is adapted for securing two saddle packs 10 to a header A-frame stand 26 (FIG. 7B) or one saddle pack to a beltboard 60 (FIG. 7C). The saddle pack adapter 224 includes a central portion 226. A first connector member 228 and a second connector member 230 extend in opposite directions from a first end of the central portion 226. Likewise, a third connector member 232 and a fourth connector member 234 extend in opposite directions from a second end of the central portion 226. The connector members 228–234 each include a leg 236 and two nubs 238 extending from opposing sides of a distal end of the leg 236. The connector members 228, 232 are each joined to the central portion 226 by a score line or perforation 240.

The central portion 226 includes an elongate slit 242 and two contoured apertures 244, 246 communicating with and extending transversely from opposing ends of the elongate slit 242. The slit 242 divides the central portion 226 into an upper transverse rung 247*a* and a lower transverse rung 247*b*. The slit 242 and apertures 244, 246 cooperate to define a resilient cantilevered tab 248. The tab 248 may include tapered side walls which are convergent in a direction toward a free end edge of the tab 248. The saddle pack adapter 224 may be formed by molding, die cutting, stamping, etc., a suitable conventional polymeric material such natural HDPE.

Figure 7B:
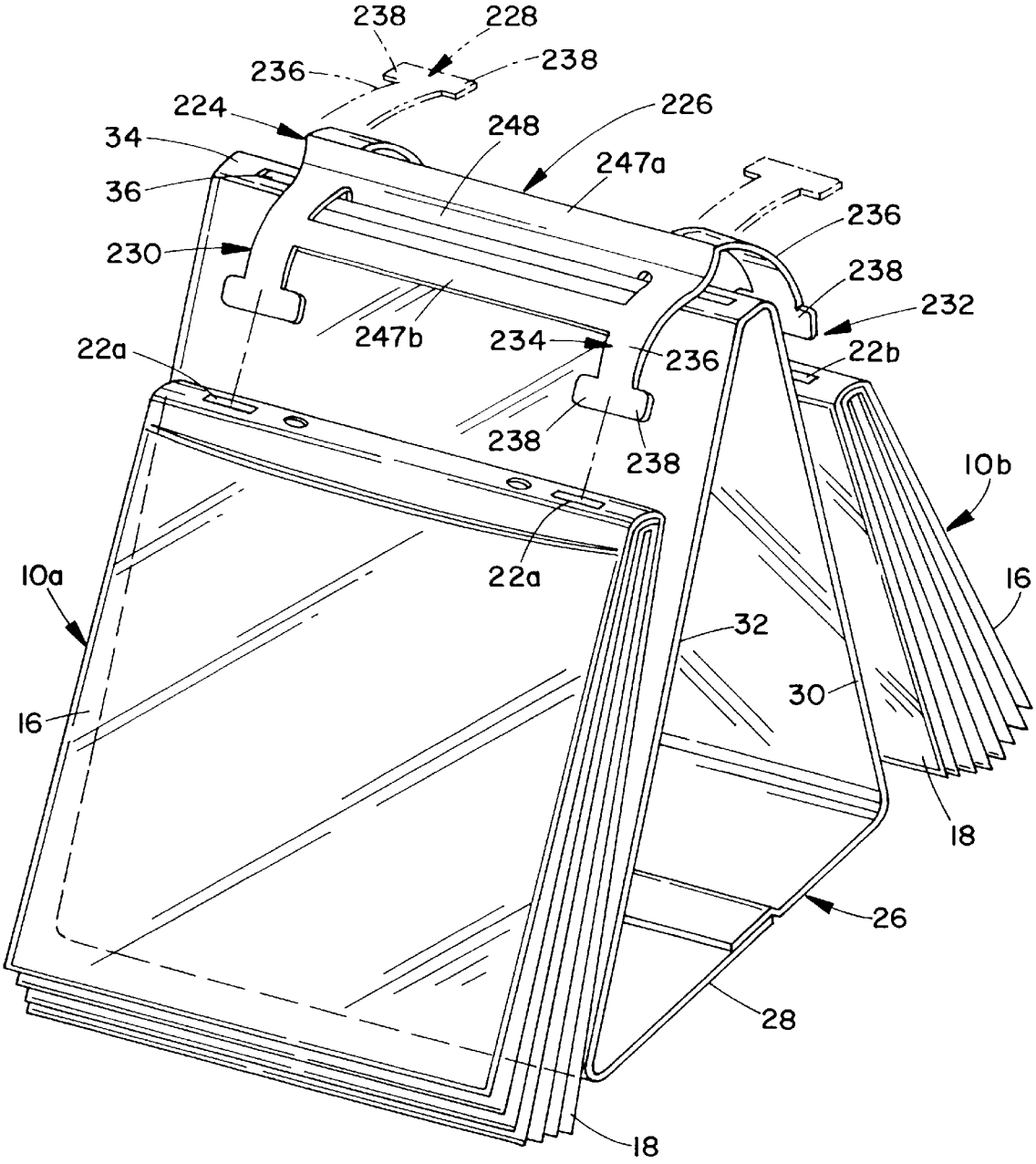
FIG. 7B is an exploded perspective view of two saddle packs of deli pouches, and the saddle pack adapter of FIG. 7A secured to a header A-frame stand for hanging the saddle packs on the A-frame stand.
Figure 7C:
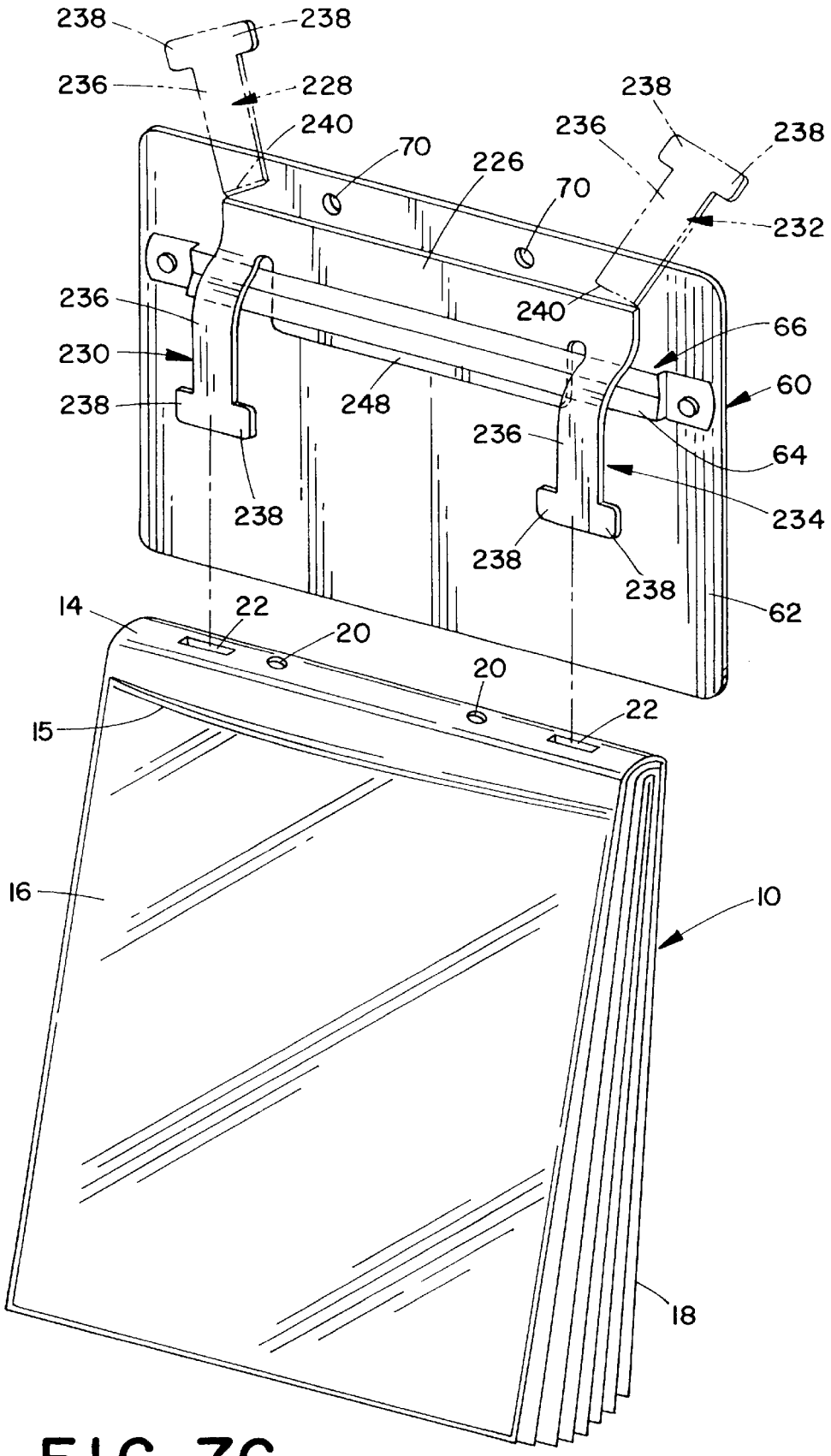
FIG. 7C is an exploded perspective view of a saddle pack of deli pouches, and the saddle pack adapter of FIG. 7A secured to a beltboard for hanging the saddle pack on the beltboard.

As shown in FIG. 7B, the saddle pack adapter 224 is joined to first and second saddle packs 10*a*, 10*b* by joining connector members 230, 234 with connector members 22*a*, and connector members 228, 232 with connector members 22*b*. In the embodiment being described, the nubs 238 associated with each of the leg portions 236 are urged through the respective slots 22*a*, 22*b*. It should be appreciated that the width/diameter of the slots 22*a*, 22*b* is approximately equal to the width of the leg portions 236. The nubs 238 can be urged through the slots 22*a*, 22*b* because one or both connector members 22 and 236 are formed from resilient, bendable, or otherwise deformable material. Once the nubs 238 have passed through the slots 22*a*, 22*b*, the nubs contact the material of the saddle packs so as to prevent the saddle packs from separating from the saddle pack adapter.

With the saddle pack adapter 224 secured to the saddle packs 10*a*, 10*b*, the adapter 224 is then mounted on the A-frame stand 26. In particular, the tab 248 is pivoted out of the plane of the saddle pack adapter 224 and is then inserted into the slot 36 associated with top edge portion 34. The closed end portion of the tab 248 is positioned proximate the top edge portion 34 when the tab 248 is seated in the slot 36.

When the tab 248 is seated in the slot 36, the deli pouches 16 of each saddle pack 10*a*, 10*b* extend outwardly from the A-frame stand and are available for receiving cold cuts, cheese, etc. At this time, the deli pouches 18 of each saddle pack 10*a*, 10*b* rest inwardly against a respective side surface 30, 32 of the A-frame stand 26. When the deli pouches 16 of both saddle packs 10*a*, 10*b* are expended (i.e., separated from the respective strips 14), the saddle pack adapter 224 may then be removed, flipped over, and then reinserted into the slot 36 so that the deli pouches 18 extend outwardly from the A-frame stand 26.

It should be appreciated that the saddle pack 10*a* may include deli pouches 16, 18 having one or more first characteristics (e.g., size, quantity, thickness, etc.) while the saddle pack 10*b* includes deli pouches 16, 18 with one or more different characteristics. Thus, the saddle pack adapter 224 permits different types of saddle packs 10*a*, 10*b* to hang from a single header A-frame stand 26.

Referring now to FIG. 7C, the saddle pack adapter 224 can also be used to secure a single saddle pack 10 to a beltboard 60. Initially, the connector members 228, 232 are separated from the central portion 226 by tearing along the perforations 240. The adapter 224 is then mounted on the beltboard 60. In particular, the tab portion 248 is pivoted out of the plane of the saddle pack adapter 224 and a free end edge thereof is inserted into the slot 66 associated with band 64. The closed end portion of the tab 248 is positioned proximate the top edge of the band 64 when the tab 248 is seated in the slot 66.

With the saddle pack adapter 224 inserted in the slot 66, the deli pouches 16 extend outwardly from the beltboard 60 and are available for receiving cold cuts, cheese, etc. The deli pouches 18 then rest inwardly against the base surface 62 of the beltboard 60. When the deli pouches 16 are expended (i.e., separated from the respective strips 14), the saddle pack adapter 224 may then be removed, rotated 180°, and then reinserted in the slot 66 so that the deli pouches 18 extend outwardly from the beltboard.

Figure 8A:
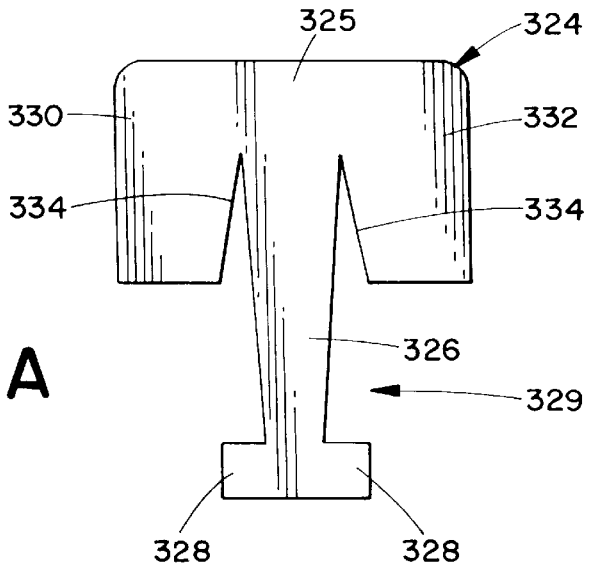
FIG. 8A is a front elevational view of a fourth embodiment of a saddle pack adapter in accordance with the present invention.
Figure 8B:
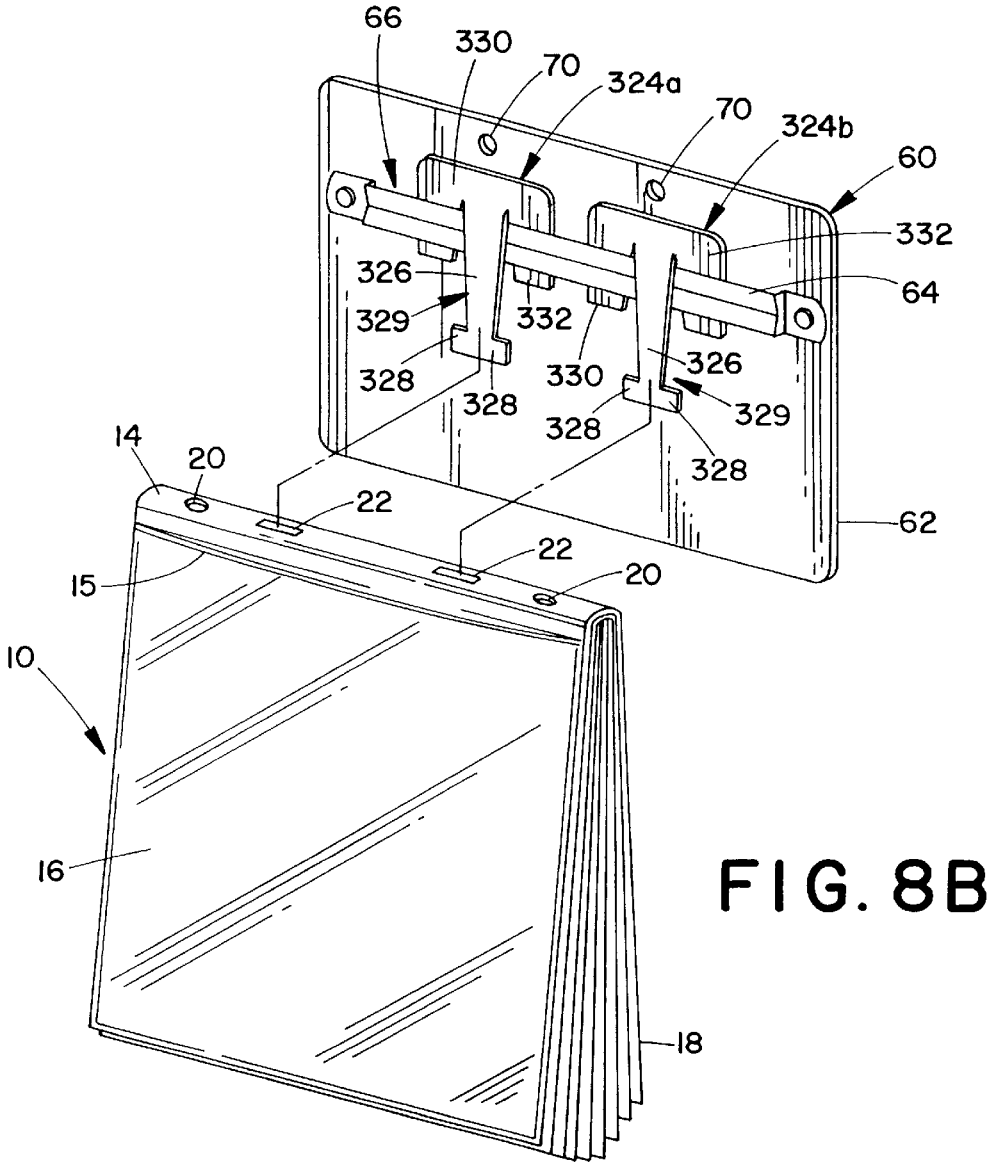
FIG. 8B is an exploded perspective view of a saddle pack of deli pouches, and two saddle pack adapters of FIG. 8A secured to a beltboard for hanging the saddle pack on the beltboard.

Referring now to FIG. 8, a saddle pack adapter 324 according to a fourth embodiment of the present invention is shown. The saddle pack adapter 324 is formed from a T-shaped planar member 325 and is adapted for securing a saddle pack 10 to a beltboard 60 (FIG. 8B), or to a header A-frame stand (not shown). The saddle pack adapter 324 includes a tapered leg 326 having two nubs 328 extending from opposite sides of a distal end thereof. The leg 326 and the nubs 328 cooperate to define a connector member 329.

Two resilient, cantilevered tabs 330, 332 extend from the member 325, one on each side of the leg 326. In particular, each tab 330, 332 is spaced from the central leg portion 326 and extends axially toward the nubs 328. Each tab 330, 332 includes a tapered inner side wall 334 which extends from the member 325 to a free end of the respective tabs 330, 332. The tapered inner side walls 334 are convergent in a direction away from the free end edges of the tabs 330, 332. The saddle pack adapter 324 may be formed by molding, die cutting, stamping, etc., a suitable polymeric material such natural HDPE.

As shown in FIG. 8B, two saddle pack adapters 324*a*, 324*b* are employed to hold a saddle pack 10 by joining the respective connector members 329 with the connector members 22. As in the previous embodiments, the nubs 328 associated with each of the leg portions 326 are urged through the respective slots 22 until the nubs extend so as to prevent the saddle pack from separating from the saddle pack adapter 324.

When the saddle pack adapters 324*a*, 324*b* are secured to the saddle pack 10 as described above, the adapters 324*a*, 324*b* are then mounted on the beltboard 60. In particular, the tabs 330, 332 of each adapter are pivoted out of the plane of the adapter and the free end edges of the tabs 330, 332 are inserted into the slot 66 associated with band 64. The tapered side walls 334 of the tabs 330, 332 facilitate inserting the tabs 330, 332 completely into the slot 66. The closed end portions of the tab 330, 332 are positioned proximate the top edge of the band 64 when the tabs 330, 332 are seated in the slot 66.

With the saddle pack adapters 324*a*, 324*b* inserted in the slot 66, the deli pouches 16 extend outwardly from the beltboard 60 and the deli pouches 18 rest inwardly against the base surface 62 thereof. When the deli pouches 16 have been expended, the saddle pack adapters 324*a*, 324*b* may then be removed from the beltboard, rotated 180°, and then reinserted into the slot 66 so that the deli pouches 18 are available.

It should be appreciated that saddle pack adapters 324 can be used to secure one or more saddle packs to a header A-frame stand in the same manner as previously described. In addition, the saddle pack adapters 324 can be used with saddle packs having any number of connector slots 22. Further, the saddle pack adapters 324 can be used with saddle packs having varying connector slot 22 positions (i.e., variable distance separating adjacent connector slots 22).

Figure 9:
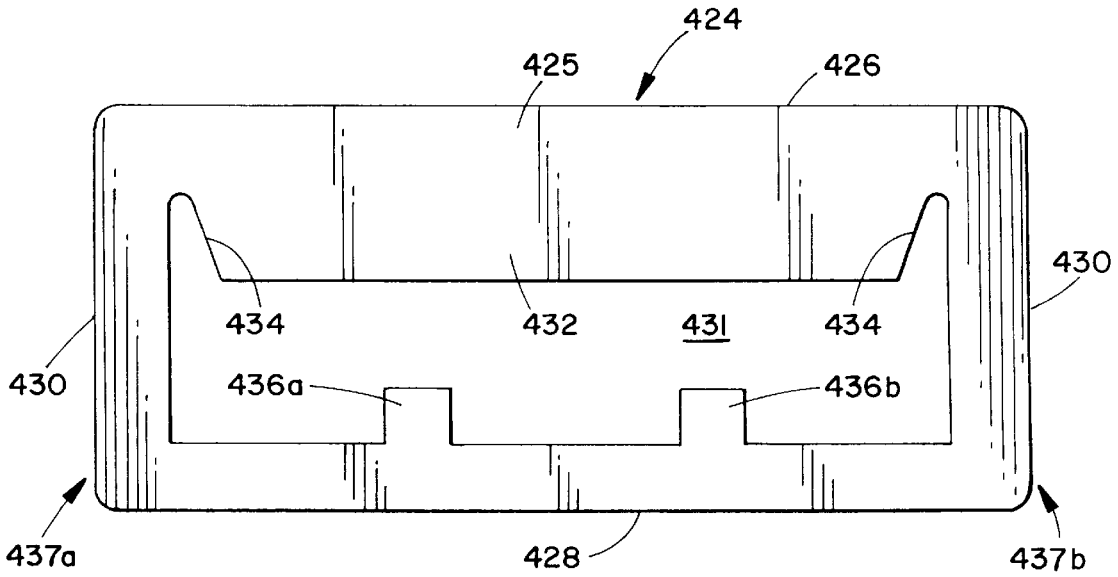
FIG. 9 is a front elevational view of a fifth embodiment of a saddle pack adapter in accordance with the present invention.

Referring now to FIG. 9, a saddle pack adapter 424 according to a fifth embodiment of the present invention is there shown. The saddle pack adapter 424 is formed from a loop-shaped planar member 425 and is adapted for securing a saddle pack to a header A-frame stand or a beltboard. The saddle pack adapter 424 includes an upper transverse rung 426 and a spaced-apart lower transverse rung 428 which are joined at mutual ends thereof by side walls 430. The upper rung 426, lower rung 428, and side walls 430 cooperate to define a closed recess 431.

The upper rung 426 defines a resilient, cantilevered tab 432. The tab 432 includes tapered side walls 434 which are convergent in a direction toward the closed recess 431. The lower rung 428 includes one or more nubs 436*a*, 436*b* which cooperate with the connector members 22 of a saddle pack to join the saddle pack adapter 424 to the saddle pack. In the embodiment being described, the spaced-apart nubs extend within the closed recess 431. The side walls 430 cooperate with adjoining ends of the lower rung 428 to define L-shaped leg portions of respective connector members 437*a*, 437*b*. The saddle pack adapter 424 may be formed by molding, die cutting, stamping, etc., a polymeric material such natural HDPE.

The saddle pack adapter 424 is secured to a saddle pack by positioning the central strips of plastic material 14 within the recess 431 whereby the lower rung 428 is interposed between the deli bags 16 and deli bags 18. The slots 22 associated with the saddle pack are then urged over the nubs 436 to prevent the saddle pack from separating from the saddle pack adapter 424.

With the saddle pack adapter 424 secured to the saddle pack 10, the adapter 424 may then be mounted on an A-frame stand or mounted on a beltboard. In particular, the tab portion 432 is pivoted out of the plane of the saddle pack adapter 424 and a free end edge of the tab portion 432 is inserted into either the slot associated with the top edge portion of the header A-frame stand, or the slot associated with the belt of the beltboard. In either case, the tapered side walls 434 facilitate inserting the tab 432 completely into the slot.

Figure 12:
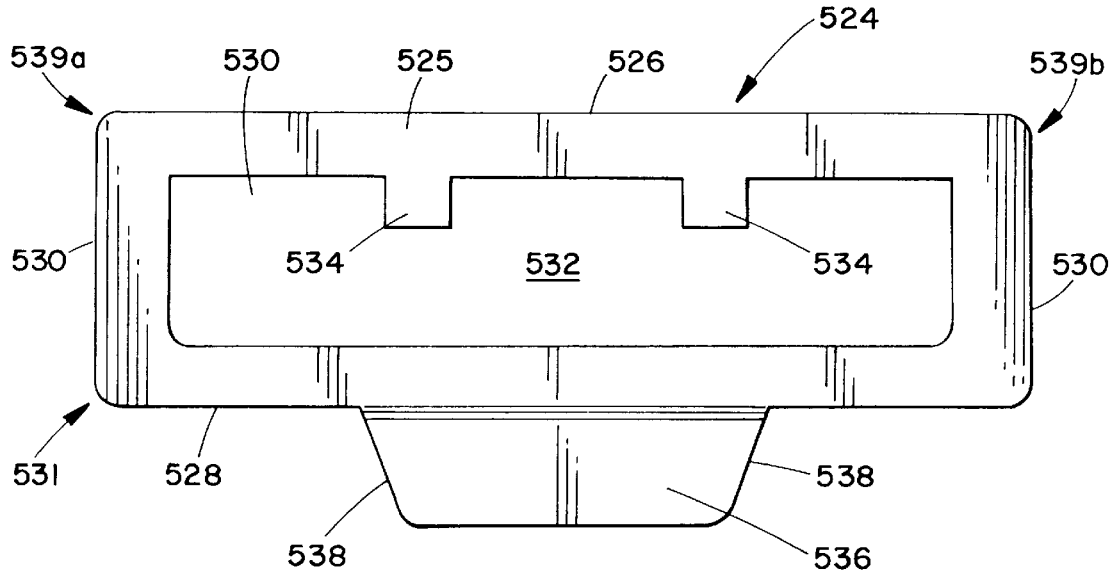
FIG. 12 is a front elevational view of an eighth embodiment of a saddle pack adapter in accordance with the present invention.

Referring now to FIG. 12, a saddle pack adapter 524 according to an eighth embodiment of the present invention is there shown. The saddle pack adapter 524 is formed from a loop-shaped planar member 525 and is adapted for securing a saddle pack to a header A-frame stand or to a beltboard. The saddle pack adapter 524 includes an upper transverse rung 526 and a spaced-apart lower transverse rung 528 which are joined at mutual ends thereof by side walls 530. The upper rung 526, lower rung 528, and side walls 530 cooperate to define a closed loop portion 531 having a central closed recess 532.

The upper rung 526 includes one or more nubs 534*a*, 534*b* which cooperate with the connector members 22 of a saddle pack to join the saddle pack adapter 524 to the saddle pack. In the embodiment being described, the nubs extend into the closed recess 532. A resilient, cantilevered tab 536 extends away from a lower surface of the lower rung 528. The tab 536 includes tapered side walls 538 which are convergent in a direction toward a free end of the tab 536. The side walls 530 cooperate with adjoining ends of the upper rung 526 to define L-shaped leg portions of respective connector members 539*a*, 539*b*. The saddle pack adapter 524 may be formed by molding, die cutting, stamping, etc., a suitable polymeric material such natural HDPE.

The saddle pack adapter 524 is secured to a saddle pack by initially orienting the saddle pack adapter 524 with the tab 536 positioned upward. The central strips of plastic material 14 are then positioned within the closed recess 532 whereby the upper rung 526 is interposed between the deli bags 16 and deli bags 18. The slots 22 associated with the saddle pack are then urged over the nubs 534 to prevent the saddle pack from separating from the saddle pack adapter 524.

With the saddle pack adapter 524 secured to the saddle pack 10, the adapter 524 may then be mounted on a header A-frame stand or mounted on a beltboard. In particular, while holding the slots 22 over the nubs 534, a free end of the tab portion 536 is inserted into either a slot associated with a header A-frame stand, or a slot associated with a beltboard. In both cases, the tapered side walls 538 facilitate inserting the tab 536 completely into the respective slot. The closed loop portion 531 is then permitted to fold down against either an angled side surface of a header A-frame stand, or against a base surface of a beltboard such that an acute angle is formed between the closed loop portion 531 and the tab 536.

The invention has been described with reference to several preferred embodiments. Obviously, modifications and alterations will occur to others upon reading and understanding the preceding detailed description. It is intended that the invention be construed as including all such modifications and alterations insofar as they come within the scope of the appended claims or the equivalents thereof.

Having thus described the preferred embodiment, the invention is now claimed to be:

1. A bag holding system comprising:

a support member having a slot;

a bag assembly having at least one first connector member; and a single-piece adapter including a planar body having at least one second connector member connected to said at least one first connector member and having a tab inserted into said slot to support said bag assembly on said support member, said second connector member including a leg portion and at least one nub extending transverse to the leg portion for keeping the bag assembly joined to the at least one second connector member.

2. The bag holding system of claim 1, wherein said bag assembly includes:

a plurality of stacked polymeric sheets each including a bag portion joined to a center strip portion by one of a score line and a perforation.

3. The bag holding system of claim 1, wherein said bag assembly includes:

a plurality of stacked polymeric sheets each including a first bag, a second bag, and a center strip portion having a first edge joined to said first bag and a second edge joined to said second bag.

4. The bag holding system of claim 1, wherein said adapter forms a closed loop having a first rung and a second rung, said tab extending from said first rung and said at least one second connector member extending from said second rung.

5. The bag holding system of claim 4, wherein said adapter includes a slit extending through said planar body to define said tab;

a first aperture communicating with said slit at a first end thereof; and a second aperture communicating with said slit at a second end thereof, said apertures facilitating inserting said tab into said slot.

6. The bag holding system of claim 4, wherein said adapter includes a central aperture extending though said planar body, and said tab extends from said first rung within said aperture.

7. The bag holding system of claim 4, wherein said adapter includes a central aperture extending though said planar body, and said at least one nub extends from said second rung within said aperture.

8. The bag holding system of claim 1, wherein said adapter further includes:

a plurality of second connector members each having a leg portion and at least one nub extending transverse to said leg portion.

9. The bag holding system of claim 8, wherein said plurality of second connector members each include an L-shaped leg portion.

10. The bag holding system of claim 9, wherein:

first L-shaped leg portion extends from a first end of said planar body;

a second L-shaped leg portion extends from a second end of said planar body, said planar body and said first and second L-shaped leg portions cooperating to define an open recess for receiving said bag assembly; and said nubs extending from each of said first and second L-shaped leg portions within said open recess.

11. The bag holding system of claim 9, wherein:

a first L-shaped leg portion extends from a first end of said planar body;

a second L-shaped leg portion extends from a second end of said planar body, said planar body and said first and second L-shaped leg portions cooperating to define a closed recess for receiving said bag assembly; and said nubs extending from each of said first and second L-shaped leg portions within said closed recess.

12. The bag holding system of claim 8, wherein a plurality of said second connector members are connected to said planar body by one of a score line and a perforation.

13. The bag holding system of claim 1, wherein:

said leg portion is a central leg portion;

said at least one nub extends from a first end of said leg portion; and said tab is joined to a second end of said leg portion.

14. The bag holding system of claim 13, wherein said adapter further includes a second tab joined to said second end of said leg portion, said second tab being spaced away from said first tab.

15. The bag holding system of claim 1, further including two nubs extending from opposing sides of the leg portion.

16. A bag assembly adapter comprising:

a unitary planar body;

a first connector member formed integrally with said planar body and adapted for engagement with a second connector member associated with a bag assembly, said first connector member including at least one leg portion and at least one nub extending transverse to the leg portion for keeping a bag assembly coined to said first connector member; and a tab member formed integrally with said planar body and adapted for engagement with a support member that supports a bag assembly.

17. The adapter of claim 16, wherein said leg portion is a central leg portion, said at least one nub extends from a first end of said central leg portion, and said tab is joined to a second end of said central leg portion.

18. The adapter of claim 16, wherein said leg portion has a free end adapted for extension through an aperture in a bag assembly; and said nub extends from said free end of said leg portion to prevent said leg portion from being freely withdrawn from an aperture in a bag assembly.

19. The adapter of claim 16, wherein said leg portion is an L-shaped leg portion and said nub is adapted for extension through an aperture in a bag assembly.

20. The adapter of claim 19, wherein said first connector member further includes a second L-shaped leg portion and at least one second nub extending transverse to the second L-shaped leg portion;

said first-mentioned L-shaped leg portion extends from a first end of said planar body;

said second L-shaped leg portion extends from a second end of said planar body, said planar body and said first-mentioned and second L-shaped leg portions cooperating to define a closed recess for receiving a bag assembly; and said nubs extending within said closed recess.

21. The bag adapter of claim 20, wherein the tab member extends within the closed recess.

22. The adapter of claim 19, wherein said first connector member further includes a second L-shaped leg portion and at least one second nub extending transverse to the second L-shaped leg portion;

said first-mentioned L-shaped leg portion extending from a first end of said planar body;

said second L-shaped leg portion extending from a second end of said planar body, said planar body and said first-mentioned and second L-shaped leg portions cooperating to define an open recess for receiving a bag assembly; and said nubs extending within said open recess.

23. The adapter of claim 16, wherein said planar body forms a closed loop having a first transverse rung and a second transverse rung, said tab extending from said first transverse rung and said first connector member extending from said second transverse rung.

24. The adapter of claim 23, further including:

a slit extending through said planar body to define said tab member;

a first aperture communicating with said slit at a first end thereof; and a second aperture communicating with said slit at a second end thereof.

25. The adapter of claim 23, further including a central aperture extending though said planar body, said tab extending from said first rung within said central aperture, and said nub extending from said second rung within said central aperture.

26. The adapter of claim 23, further including a central aperture extending though said planar body, said tab extending from said first rung outside of said central aperture, and said nub extending from said second rung within said aperture.

27. The adapter of claim 16, further comprising at least one third connector member forming a further portion of said planar body for engaging with at least one fourth connector member associated with a second bag assembly.

28. The adapter of claim 27, wherein at least one of said first connector member and said third connector member are joined to said planar body by one of a score line and a perforation.

29. The bag adapter of claim 16, further including two nubs extending from opposing sides of the leg portion.

30. A method of securing a bag assembly to a support member, the bag assembly including a plurality of stacked polymeric sheets each including a bag portion connected to a center strip portion by one of a score line and a perforation, the plurality of center strip portions being joined together and having a connector member including an aperture extending through the center strip portions, comprising:

providing a single-piece adapter member having a first portion and a second portion, the first portion including a leg member and a nub extending transverse to a free end of the leg member, and the second portion including a tab member;

securing the first portion of the adapter member to the connector member by inserting the nub through the aperture to keep the bag assembly joined to the adapter; and securing the tab member to the support member.

31. The method of claim 30, wherein the first securing step includes the subsidiary step of:

inserting the leg member through the aperture until the nub projects through the aperture.

32. The method of claim 31, wherein the second securing step includes the subsidiary step of:

inserting the tab member into a slot defined on the support member.

* * * * *